US006225265B1

(12) United States Patent
Shibuya et al.

(10) Patent No.: US 6,225,265 B1
(45) Date of Patent: May 1, 2001

(54) MINIATURE ELECTRIC MOTOR WITH REDUCTION WORM GEAR UNIT

(75) Inventors: Isao Shibuya, Chiba-Ken; Junya Kurata, Matsudo, both of (JP)

(73) Assignee: Mabuchi Motor Co., Ltd., Matsudo (JP)

( * ) Notice: Subject to any disclaimer, the term of this patent is extended or adjusted under 35 U.S.C. 154(b) by 0 days.

(21) Appl. No.: 09/310,159

(22) Filed: May 12, 1999

(30) Foreign Application Priority Data

May 15, 1998 (JP) ..... 10-152217

(51) Int. Cl.[7] ..... C10M 125/26

(52) U.S. Cl. ..... 508/136; 508/138; 508/144; 508/137; 74/467

(58) Field of Search ..... 508/136, 138, 508/137, 144; 74/467

(56) References Cited

U.S. PATENT DOCUMENTS 2,968,999 * 1/1961 Breton .
3,595,789 * 7/1971 Coshburn .
3,775,317 * 11/1973 Inami et al. .
4,396,514 8/1983 Randisi .
4,840,739 * 6/1989 Mori et al. .
5,037,566 8/1991 Randisi .
5,050,959 * 9/1991 Ramdisi .
5,364,544 * 11/1994 Otake et al. .
5,404,060 * 4/1995 Nakahashi et al. ..... 310/83
5,505,773 * 4/1996 Vitands et al. .
5,854,185 * 12/1998 Roth et al. ..... 508/492

OTHER PUBLICATIONS

Database WPI Derwent Publications Ltd., London, GB; AN 1998–082973 XP002117451.

* cited by examiner

*Primary Examiner*—Margaret Medley
(74) *Attorney, Agent, or Firm*—Armstrong, Westerman, Hattori, McLeland & Naughton, LLP

(57) ABSTRACT

In a miniature electric motor with reduction worm gear unit, a reduction worm gear unit is mounted on a motor portion and an output of the motor portion is subjected to a speed reduction through the unit. In lubricant for lubricating worm gears of the unit, fine silica grain is added and mixed to base oil, and a content of the fine silica grain is in a range of about 3 to about 10 wt. %. It is possible to always maintain reverse rotation proof while always keeping a desired gear transmission efficiency in a wide environmental temperature range. As a result, it is possible to miniaturize a motor and also to increase a life cycle number to prolong service life of the motor. The motor may be applied to an electric window device of an automotive vehicle.

20 Claims, 8 Drawing Sheets

MINIATURE ELECTRIC MOTOR WITH REDUCTION WORM GEAR UNIT

BACKGROUND OF THE INVENTION

1. Field of the Invention

The present invention relates to a miniature electric motor with reduction worm gear unit and more particularly to a miniature electric motor with reduction worm gear unit used for driving an electric window device of an automotive vehicle.

2. Description of the Related Art

A miniature electric motor with reduction worm gear unit (hereinafter simply referred to as a motor) has been conventionally and extensively used for driving the electric window device, an electric sunroof device or the like. The motor has a motor portion and a reduction worm gear unit for producing an output of the motor portion through the reduction worm gear unit.

Lubricant (mainly, grease) having good wear resistance is used for lubricating worm gears of the reduction worm gear unit.

By the way, the electric window device performs opening/closing operations of a window glass of an automotive vehicle. The motor used in the electric window device requires such reverse rotation proof that the motor is never reversed for burglar proof and security even if an external force is applied in an opening direction to the window glass.

In general, an automotive vehicle is used in a wide range of temperature (for example, −30° C. to +80° C.). Therefore, the motor for the electric window device always requires the reverse rotation proof in this environmental temperature range.

Conventionally, there have been proposed a variety of lubricants having general reverse rotation proof. However, there are almost no lubricants for which the reverse rotation proof of the worm gears is taken into consideration. Namely, in the case where conventional lubricant is used for the worm gears, a transmission efficiency of gears is largely changed when the environmental temperature changes.

For this reason, there is a possibility that the window glass of the automotive vehicle might be opened from the outside by the external force in some environmental temperature range. This is disadvantageous in the aspect of the burglar proof and security. In order to solve this problem, it is necessary to ensure the gear transmission efficiency so that the reverse rotation proof may be always maintained even in the worst environmental temperature range.

Therefore, in the conventional motor, the first countermeasure thereof is that a lead angle of a worm is extremely decreased, or the second countermeasure is that a brake device is installed within an interior of the motor, or the third countermeasure is that mat finishing is effected to rough mesh tooth surfaces of the gears in a mat finish manner to increase a frictional coefficient, thereby maintaining the reverse rotation proof.

However, as in the first countermeasure, if the lead angle of the worm is decreased, an outer diameter of the worm is naturally increased so that it is difficult to miniaturize the motor as a whole. If the brake device is provided as in the second countermeasure, the number of the parts of the motor and the number of the steps for assembly are increased, resulting in increased cost.

The third countermeasure is proposed by the present applicant or assignee (Japanese Patent No. 2636958). The mat finishing for increasing the frictional coefficient of the mesh surfaces of the gears and the maintenance work thereof are required.

Thus, with the first to third countermeasures, since the gear transmission efficiency is decreased so that the reverse rotation proof is always maintained in the environmental temperature range, it is difficult to miniaturize the motor. Also, the conventional methods suffer from the difficulty in temperature characteristics.

SUMMARY OF THE INVENTION

In order to solve the above-noted defects, an object of the present invention is to provide a miniature electric motor with reduction worm gear unit, which always may maintain reverse rotation proof while always keeping a desired gear transmission efficiency in a wide environmental temperature range, thereby making it possible to miniaturize an overall size of the motor.

In order to attain this and other objects, according to the present invention, there is provided a miniature electric motor with reduction worm gear unit in which a reduction worm gear unit is mounted on a motor portion and an output of the motor portion is subjected to a speed reduction through the reduction worm gear unit, characterized in that: in lubricant for lubricating worm gears of the reduction worm gear unit, fine silica grain is added and mixed to base oil, and a content of the fine silica grain is in a range of about 3 to about 10 wt. (weight) %.

Incidentally, it is preferable that a granular size of the fine silica grain is in a range of about 7 to about 40 nm. It is preferable that at least one selected from the group of oiliness improver, viscosity improver, solid lubricant and consistency increasing agent is added and mixed to the lubricant into which the fine silica grain is added.

It is preferable that the oiliness improver is at least one selected from the group of sorbitan fatty acid ester and ester structured of copolymer; the viscosity improver is at least one selected from the group of polyisobutylene, polybutene, low molecular weight polyethylene, polybutadiene and poly methacrylate; the solid lubricant is selected from the group of melamine resin, silicone resin, paraffin and fluorocarbon resin; and the consistency increasing agent is selected from the group of lithium soap, bentonite and polyurea resin.

For example, the oiliness improver is sorbitan monooleate or oiliness improver mixed with pentaerythritol ester and dipentaerythritol ester. Also, the solid lubricant contains boron nitride and fine electric black lead powder.

It is preferable that at least one selected from the group of the oiliness improver, the viscosity improver, the solid lubricant and the consistency increasing agent is added and mixed to the lubricant into which the fine silica grain is added is in a range of about 0.2 to about 20.0 wt. %. For example, the content of the consistency increasing agent is in a range of about 0.5 to about 2.5 wt. %.

It is preferable that the base oil is chemical synthetic hydrocarbon oil or mineral oil that is superior in low temperature characteristics, attacked resin and corrosiveness. Also, it is preferable that chemical synthetic hydrocarbon oil is ethylene-α-olefin copolymer or poly-α-olefin.

For example, the reduction worm gear unit drives an electric window device for automatically opening/closing a window glass of an automotive vehicle. For example, the worm gears are composed of a worm formed out of carbon steel and a worm wheel formed out of synthetic resin.

The worm gears exhibit the first function that reverse rotation proof is maintained by a predetermined static frictional force so that the window glass is not opened by an external force when the electric window device is kept under a static condition, and the second function that the worm gears are smoothly rotated with a small frictional force equal to or less than a maximum value of a dynamic frictional force while the dynamic frictional force is abruptly reduced during the rotation after the miniature electric motor is turned on to a dynamic friction from a static friction for keeping the reverse rotation proof. For example, an environmental temperature range of the miniature electric motor is in a range of −30° C. to +80° C.

According to the present invention, with the above-noted arrangement and composition, it is possible to always maintain the reverse rotation proof while always keeping a desired gear transmission efficiency in a wide environmental temperature range. As a result, it is possible to miniaturize a motor and also to increase a life cycle number to prolong service life of the motor. The miniature electric motor may be applied to an electric window device of an automotive vehicle.

BRIEF DESCRIPTION OF THE DRAWINGS

FIG. 1 is a schematic view showing a structure of an electric window device.

FIG. 2 is a frontal view showing a miniature electric motor with reduction worm gear unit.

FIG. 3 is a graph showing a relationship between a frictional force of worm gears and a time.

FIG. 4 is a graph showing a relationship between a gear transmission efficiency and reverse rotation torque proof.

FIG. 5 is a graph showing a relationship between an environmental temperature and a gear transmission efficiency.

FIG. 6 is a graph showing a relationship between the gear transmission efficiency and the environmental temperature for every content of fine silica grain.

FIG. 7 is a graph showing a relationship between a life cycle number and the gear transmission efficiency at each content of the fine silica grain.

FIG. 8 is a graph showing a relationship between a life cycle number and the gear transmission efficiency by additive components.

DESCRIPTION OF THE PREFERRED EMBODIMENTS

An example of one embodiment of the present invention will now be described with reference to FIGS. 1 to 8.

For instance, a miniature electric motor with reduction worm gear unit is used in an actuator or the like for driving an automotive electric equipment such as an electric window device for automatically opening/closing a window glass of an automotive vehicle and an electric sunroof device mounted on a ceiling portion of a vehicle body.

Figure 1:
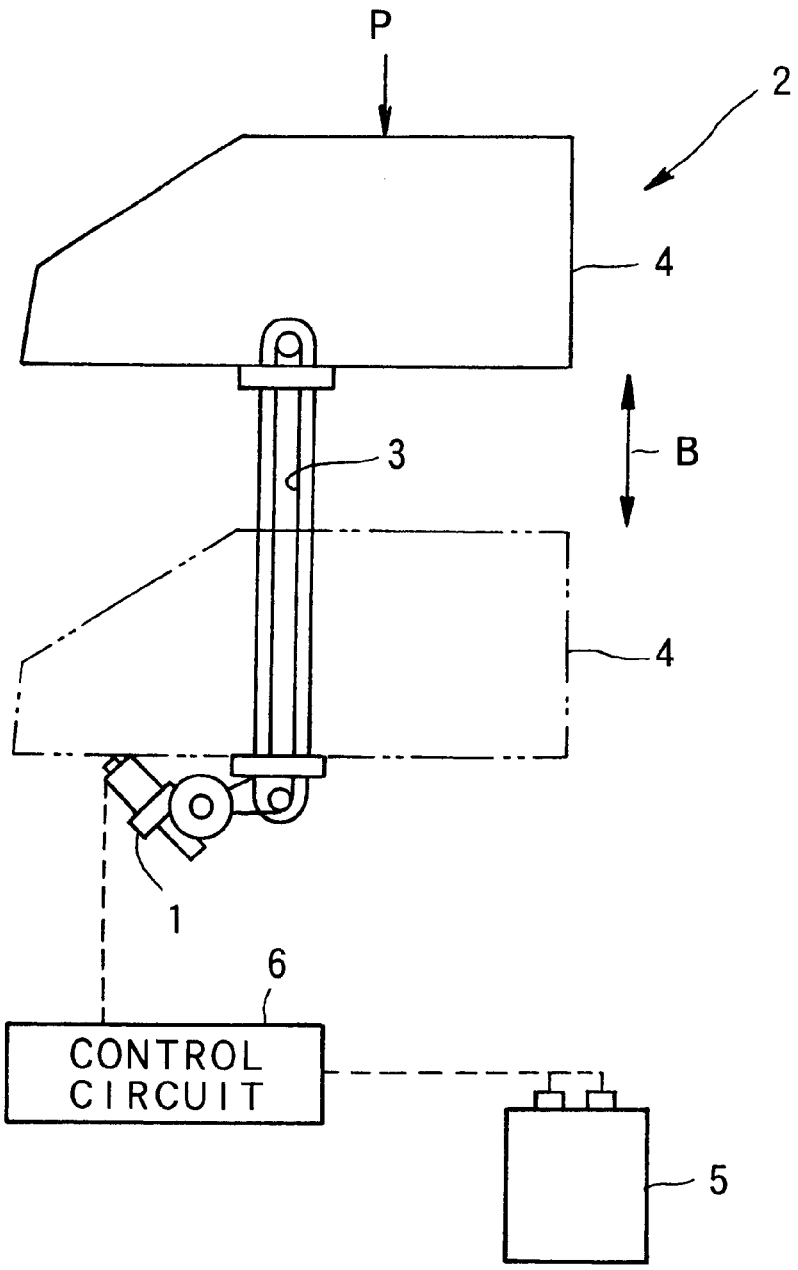
FIGS. 1 to 8 show an embodiment of the present invention.
Figure 2:
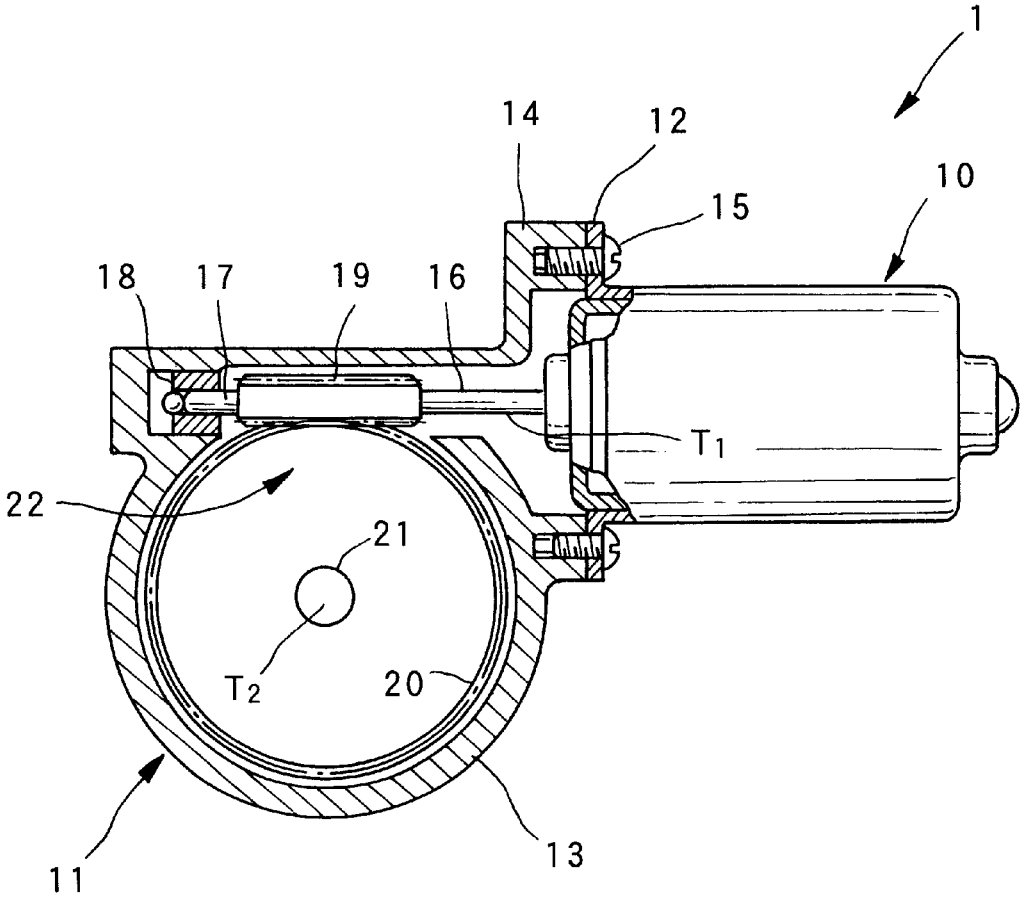

FIG. 1 is a schematic illustration of a structure of the electric window device. FIG. 2 is a partially fragmentary frontal view of the miniature electric motor with reduction worm gear unit. FIG. 1 shows the case where the miniature electric motor 1 with reduction worm gear unit (hereinafter referred to as a motor 1) is used in the electric window device 2.

As shown in FIGS. 1 and 2, in the electric window device 2, when a wire cable 3 is driven and moved by the motor 1, a window glass 4 retained on the wire cable 3 is opened/closed as indicated by a two-headed arrow B.

A driving current fed from an automotive battery 5 is supplied to the motor 1 under an on/off control and the switch-over between reverse and forward rotations by a control circuit 6. The motor 1 is rotated in the forward or reverse direction by the driving current to thereby drive the electric window device 2.

The motor 1 is provided with a motor portion 10 and a reduction worm gear unit (reduction worm gears) 11 mounted on the motor portion 10 for reducing the speed of the output of the motor portion 10 through the reduction worm gear unit 11.

A mounting portion 14 of a gear case side is provided on a gear case 13 of the reduction worm gear unit 11. A flange portion 12 of the motor portion 10 is fastened and fixed to the gear case side mounting portion 14 by screws 15.

A worm 19 is mounted on a motor shaft 16 of the motor portion 10. A distal end portion 17 of the motor shaft 16 is pivotally supported to the gear case 13 by a bearing 18.

A worm wheel 20 engaged with the worm 19 is rotatably mounted in an interior of the gear case 13. The worm wheel 20 may be made by a helical gear. An output shaft 21 is mounted on a central portion of the worm wheel 20. Worm gears 22 are constituted by the worm 19 and the worm wheel 20.

The worm 19 is formed out of carbon steel for a mechanical structure. The worm wheel 20 and the gear case 13 are formed out of synthetic resin, respectively. Accordingly, in the worm gears 22, the metal and the synthetic resin are engaged with each other.

In the electric window device 2 having the motor 1 with such an arrangement, when the driving current is fed from the battery 5 to the motor portion 10 in accordance with a control signal from the control circuit 6, the motor portion 10 is driven to rotate the motor shaft 16 in the forward or reverse direction.

A driving torque of the motor shaft 16 is transmitted to the worm 19. Subsequently, the driving torque is transmitted from the worm 19 to the worm wheel 20 and the output shaft 21, and is outputted from the output shaft 21 to an outside. The wire cable 3 of the electric window device 2 is moved by the driving torque so that the window glass 4 is automatically opened or closed.

For example, main functions (1) to (4) required for the motor 1 of the electric window device 2 are as follows:

(1) The desired gear transmission efficiency may be always kept in a wide environmental temperature range (for example, −30° C. to +80° C.) to ensure a reverse rotation property.

(2) Since the motor 1 is assembled in a limited space within an interior of a door of the automotive vehicle, the motor as a whole should be miniaturized.

(3) The window glass 4 may be repeatedly opened or closed. Namely, a life cycle number (corresponding to service life of the motor 1) should be large.

(4) The motor 1 should be operated with a low noise to be quiet.

According to the present invention, lubricant (mainly grease) for lubricating the worm gears 22 of the reduction worm gear unit 11 has a predetermined mixed composition so that the motor 1 may satisfactorily meet the functions (1) to (4).

The grease as the lubricant for lubricating the worm gears 22 will be now described.

Figure 3:
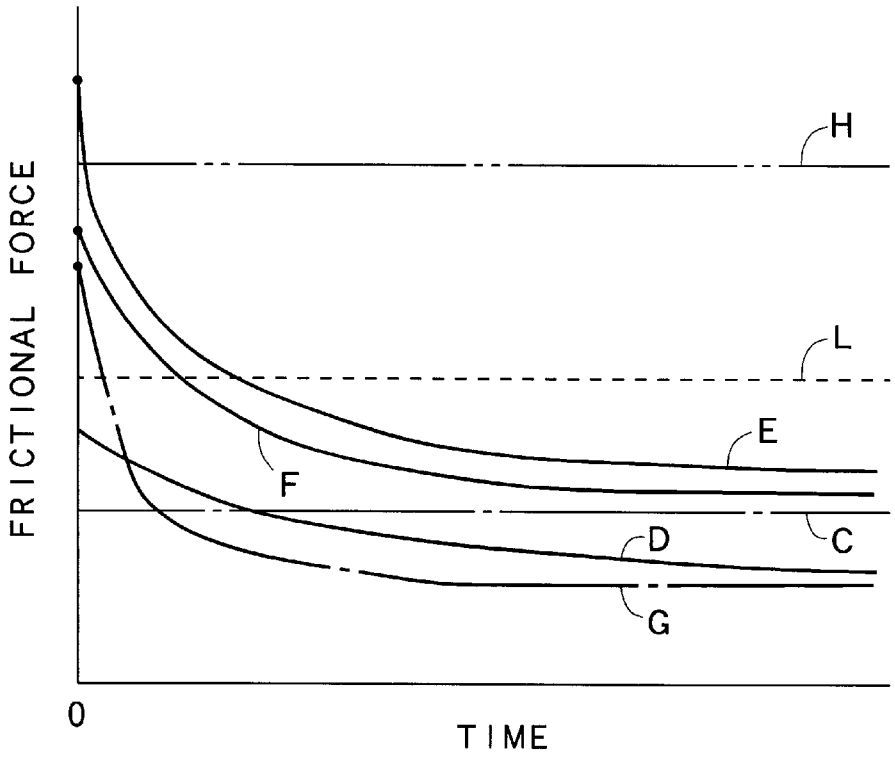

FIG. 3 is a graph showing a relationship between a time and a frictional force of the worm gears 22. The abscissa axis of FIG. 3 represents the time and the ordinate axis represents the frictional force.

In FIG. 3, reference characters H and L represent a maximum value and a minimum value of desired static frictional forces (namely, the values of frictional forces when the time represents zero), respectively. If the static frictional force is plotted between the minimum value L and the maximum value H, desired reverse rotation proof is obtained.

A reference character C represents a maximum value of desired dynamic frictional forces when the worm gears 22 are rotated to transmit a dynamic torque.

As an example, in the case where the worm gears 22 are lubricated by conventional grease as indicated by a curve D of FIG. 3, since the dynamic frictional force in a lapse of a predetermined time is smaller than the maximum value C, the worm gears 22 may be rotated smoothly.

However, with the conventional grease in many cases, the static frictional force is smaller than the minimum value L as indicated by the curve D. For this reason, when an external force P in an opening direction is applied to the window glass 4 in a static condition of the electric window device 2, the reverse rotation proof may not be maintained in the worm gears 22. Therefore window glass 4 would be opened.

On the other hand, if a lead angle of the worm would be extremely decreased as described above to decrease the gear transmission efficiency, as indicated by a curve E, the static frictional force would exceed the maximum value H so that the motor would not be rotated in the static condition.

For this countermeasure, the reverse rotation proof is maintained well as indicated by a curve F, but the dynamic frictional force tends to be greater than the maximum value C. For this reason, in order to keep a desired performance, it is necessary to enlarge the motor.

Therefore, it is desired that, as indicated by a curve G, the worm gears 22 exhibit the first function that the reverse rotation proof is maintained by the predetermined static frictional force so that the window glass 4 is not opened by the external force when the electric window device 2 is kept under the static condition, and the second function that the worm gears 22 may be smoothly rotated with the dynamic frictional force equal to or less than the maximum value C when the motor is rotated.

Namely, it is desired that, as indicated by the curve G, the worm gears 22 may be smoothly rotated with a small frictional force while the dynamic frictional force is abruptly reduced after the motor 1 is turned on to a dynamic friction from a static friction for maintaining the reverse rotation proof.

For this reason, according to the present invention, the worm gears 22 are lubricated with grease into which fine silica ($SiO_2$) grain to base oil is added and mixed so that the frictional force of the worm gears 22 is changed along the curve G to perform the mutually conflicting first and second functions.

Incidentally, Japanese Patent No. 2522874 discloses a conventional technique that grease, in which silica aero gel is added and mixed to base oil and which increases consistency, is impregnated into a porous sliding bearing. However, the grease is produced for the sliding bearing. Also, this patent is different from the present invention in object, structure and resultant effect.

(Embodiment)

An example of the embodiment of the present invention will now be described.

In this embodiment, as shown in FIGS. 1 and 2, the motor 1 was assembled into the electric window device 2 to perform measurement of torques or the like. The structure of the worm gears 22 and the motor portion 10 was as follows:

lead angle of the worm 19: about 4° reduction gear ratio: 85:1 output torque $T_1$ of the motor portion 10: 0.31 N·m

The output torque $T_1$ of the motor portion 10 was the torque before the speed deceleration. The torque of the motor shaft 16 was measured for the output torque $T_1$. Also, the torque of the output shaft 21 was measured for the output torque $T_2$ after the speed deceleration.

These output torques $T_1$ and $T_2$ are so-called stall torques (Ts). The stall torques are representative of values of torques when a load of the motor is increased during the rotation of the motor 1 and then the motor rotation is stopped.

The gear transmission efficiency η(%) is calculated by following equation by using the output torque $T_1$ before the speed deceleration, the output torque $T_2$ after the speed deceleration and the reduction gear ratio.

$$\eta=[T_2/(T_1\times\text{reduction gear ratio})]\times 100(\%)$$

As is apparent from this equation, the larger the value of the gear transmission efficiency η, the larger the output torque $T_2$ after the deceleration would become. Accordingly, a loss of the power transmission during the rotation of the worm gears 22 is small.

Tables 1 and 2 represent comparison of the ingredients and initial characteristics of the grease between examples ("Ex." in Tables and Figures) 1 to 32 according to the present invention and conventional examples ("Con." in Tables and Figures) 1 to 8 using the conventional grease. The initial characteristics include the gear transmission efficiency and the absence/presence of the generation of abnormal noise.

TABLE 1

| | | Initial characteristics | | | | Constituent material 1 (Consistency increasing agent) | | | | Constituent material 2 (grease base oil) | | |
|---|---|---|---|---|---|---|---|---|---|---|---|---|
| | Environmental temp. | Gear transmission efficiency η [%] −30° C. | 25° C. | 80° C. | Generation of abnormal noise | Material 1 | Content wt. % | Material 2 | Content wt. % | Material | Content wt. % | Viscosity cSt |
| Study on content of fine silica grain | Ex. 1 | Impossible to conduct experiment because of liquescence | | | | Fine silica grain | 2.0 | | | Ethylene-α-olefin copolymer | 87.5 | 380 |
| | Ex. 2 | 47.3 | 47.4 | 46.9 | nil | Fine silica grain | 3.0 | — | — | Ethylene-α-olefin copolymer | 86.2 | 380 |
| | Ex. 3 | 46.7 | 47.1 | 47.0 | nil | Fine silica grain | 4.0 | — | — | Ethylene-α-olefin copolymer | 85.2 | 380 |
| | Ex. 4 | 46.5 | 46.8 | 46.6 | nil | Fine silica grain | 5.0 | — | — | Ethylene-α-olefin copolymer | 84.2 | 380 |
| | Ex. 5 | 46.1 | 46.3 | 46.3 | nil | Fine silica grain | 6.0 | — | — | Ethylene-α-olefin copolymer | 83.2 | 380. |
| | Ex. 6 | 45.8 | 46.2 | 45.9 | nil | Fine silica grain | 7.0 | — | — | Ethylene-α-olefin copolymer | 82.2 | 380 |
| | Ex. 7 | 45.4 | 46 | 46 | yes | Fine silica grain | 8.5 | — | — | Ethylene-α-olefin copolymer | 80.5 | 380 |
| | Ex. 8 | 45.4 | 45.7 | 45.8 | yes | Fine silica grain | 10.0 | — | — | Ethylene-α-olefin copolymer | 79.0 | 380 |
| | Ex. 9 | 43.9 | 44.3 | 44.4 | yes | Fine silica grain | 12.0 | — | — | Ethylene-α-olefin copolymer | 78.0 | 250 |
| | Ex. 10 | 42.2 | 42.1 | 42.4 | yes | Fine silica grain | 18.0 | — | — | Ethylene-α-olefin copolymer | 70.5 | 250 |
| | Ex. 11 | 41.4 | 41.4 | 41.1 | yes | Fine silica grain | 25.0 | — | — | Ethylene-α-olefin copolymer | 63.5 | 250 |
| Study on service life, abnormal noise counter-measure and viscosity improver | Ex. 12 | 45.9 | 46.1 | 45.9 | nil | Fine silica grain | 7.0 | — | — | Ethylene-α olefin copolymer | 82.0 | 380 |
| | Ex. 13 | 45.8 | 45.8 | 45.6 | nil | Fine silica grain | 10.0 | — | — | Ethylene-α-olefin copolymer | 79.0 | 380 |
| | Ex. 14 | 50.3 | 51.3 | 51.7 | nil | Fine silica grain | 10.0 | — | — | Ethylene-α-olefin copolymer | 75.9 | 380 |
| | Ex. 15 | 45.7 | 45.7 | 46.0 | nil | Fine silica grain | 10.0 | — | — | Ethylene-α-olefin copolymer | 69.1 | 380 |
| | Ex. 16 | 49.4 | 49.5 | 49.9 | nil | Fine silica grain | 10.0 | — | — | Ethylene-α-olefin copolymer | 78.0 | 380 |
| | Ex. 17 | 50.6 | 51.3 | 52.0 | nil | Fine silica grain | 10.0 | — | — | Ethylene-α-olefin copolymer | 62.3 | 380 |
| Study on service life, abnormal noise counter-measure and solid lubricant | Ex. 18 | 51.0 | 51.1 | 52.1 | nil | Fine silica grain | 12.0 | — | — | Ethylene-α-olefin copolymer | 66.5 | 380 |
| | Ex. 19 | 46.1 | 46.4 | 46.2 | nil | Fine silica grain | 6.0 | — | — | Ethylene-α-olefin copolymer | 72.4 | 380 |
| | Ex. 20 | 45.2 | 45.4 | 45.3 | nil | Fine silica grain | 12.0 | — | — | Ethylene-α-olefin copolymer | 66.4 | 380 |
| | Ex. 21 | 34.3 | 34.2 | 34.7 | nil | Fine silica grain | 12.0 | — | — | Ethylene-α-olefin copolymer | 66.4 | 380 |
| | Ex. 22 | 49.4 | 49.1 | 50.1 | nil | Fine silica grain | 12.0 | — | — | Ethylene-α-olefin copolymer | 66.4 | 380 |
| Study on service life, abnormal noise | Ex. 23 | 43.6 | 43.5 | 43.9 | nil | Fine silica grain | 7.0 | — | — | Ethylene-α-olefin copolymer | 80.9 | 380 |

TABLE 1-continued

| | | Initial characteristics | | | | Constituent material 1 (Consistency increasing agent) | | | | Constituent material 2 (grease base oil) | | |
|---|---|---|---|---|---|---|---|---|---|---|---|---|
| | Environmental temp. | Gear transmission efficiency η [%] −30° C. | 25° C. | 80° C. | Generation of abnormal noise | Material 1 | Content wt. % | Material 2 | Content wt. % | Material | Content wt. % | Viscosity cSt |
| counter-measure and solid lubricant and study on content | Ex. 24 | 44.0 | 43.6 | 43.8 | nil | Fine silica grain | 7.0 | — | — | Ethylene-α-olefin copolymer | 78.9 | 380 |
| | Ex. 25 | 43.5 | 43.2 | 43.9 | nil | Fine silica grain | 7.0 | — | — | Ethylene-α-olefin copolymer | 76.9 | 380 |
| Study on service life, abnormal noise counter-measure and lithium content | Ex. 26 | 44.5 | 43.8 | 44.8 | nil | Fine silica grain | 6.3 | Lithium soap | 0.5 | Ethylene-α-olefin copolymer | 83.0 | 380 |
| | Ex. 27 | 45.4 | 45.4 | 45.1 | nil | Fine silica grain | 5.6 | Lithium soap | 1.5 | Ethylene-α-olefin copolymer | 84.1 | 380 |
| | Ex. 28 | 45.2 | 45.5 | 45.2 | nil | Fine silica grain | 4.9 | Lithium soap | 2.5 | Ethylene-α-olefin copolymer | 84.6 | 380 |
| | Ex. 29 | 47.0 | 47.3 | 48.5 | nil | Fine silica grain | 3.9 | Lithium soap | 3.0 | Ethylene-α-olefin copolymer | 85.1 | 380 |
| | Ex. 30 | 48.2 | 50.9 | 53.0 | nil | Fine silica grain | 2.9 | Lithium soap | 4.0 | Ethylene-α-olefin copolymer | 85.0 | 380 |
| | Ex. 31 | 45.1 | 45.3 | 45.2 | nil | Fine silica grain | 5.6 | Lithium soap | 1.5 | Poly-α-olefin | 83.8 | 65 |
| | Ex. 32 | 45.2 | 45.6 | 45.5 | nil | Fine silica grain | 4.9 | Lithium soap | 2.5 | Poly-α-olefin | 84.6 | 65 |
| Lithium soap | Con. 1 | 39.8 | 43.3 | 45.3 | nil | — | — | Lithium soap | 3.0 | Ethylene-α-olefin copolymer | 91.1 | 65 |
| | Con. 2 | 44.1 | 46.0 | 47.8 | nil | — | — | Lithium soap | 7.0 | Ethylene-α-olefin copolymer | 87.0 | 65 |
| | Con. 3 | 45.6 | 48.4 | 50.5 | nil | — | — | Lithium soap | 12.0 | Ethylene-α-olefin copolymer | 82.0 | 65 |
| | Con. 4 | 48.0 | 50.3 | 52.4 | nil | — | — | Lithium soap | 20.0 | Ethylene-α-olefin copolymer | 74.0 | 65 |
| Bentonite | Con. 5 | 41.7 | 41.4 | 51.9 | nil | — | — | Bentonite | 16.0 | Poly-α-olefin | 63.1 | 65 |
| | Con. 6 | 40.5 | 46.6 | 51.5 | nil | — | — | Bentonite | 16.0 | Ethylene-α-olefin copolymer | 63.1 | 155 |
| | Con. 7 | 42.0 | 47.7 | 52.1 | nil | — | — | Bentonite soap | 16.0 | Ethylene-α-olefin copolymer | 63.1 | 380 |
| Mat finished worm | Con. 8 | 45.4 | 44 | 41.3 | nil | — | — | Bentonite | 12.0 | Ethylene-α- | 82.0 | 65 |

TABLE 2

| | | Constituent material 3 (viscosity improver) | | Constituent material 4 (oiliness improver) | | Constituent material 5 (solid lubricant) | | |
|---|---|---|---|---|---|---|---|---|
| | | Material | Content wt. % | Material | Content wt. % | Material | Content wt. % | Anticorrosive and antioxidant |
| Study on content of fine silica grain | Ex. 1 | — | — | Oiliness improver mixed with pentaerythritol ester and dipentaerythritol ester | 10.0 | — | — | Left |
| | Ex. 2 | — | — | Oiliness improver mixed with pentaerythritol ester and dipentaerythritol ester | 10.0 | — | — | " |
| | Ex. 3 | — | — | Oiliness improver mixed with pentaerythritol ester and dipentaerythritol ester | 10.0 | — | — | " |

TABLE 2-continued

| | | Constituent material 3 (viscosity improver) | | Constituent material 4 (oiliness improver) | | Constituent material 5 (solid lubricant) | | |
|---|---|---|---|---|---|---|---|---|
| | | Material | Content wt. % | Material | Content wt. % | Material | Content wt. % | Anticorrosive and antioxidant |
| | Ex. 4 | — | — | Oiliness improver mixed with pentaerythritol ester and dipentaerythritol ester | 10.0 | — | — | " |
| | Ex. 5 | — | — | Oiliness improver mixed with pentaerythritol ester and dipentaerythritol ester | 10.0 | — | — | " |
| | Ex. 6 | — | — | Oiliness improver mixed with pentaerythritol ester and dipentaerythritol ester | 10.0 | — | — | " |
| | Ex. 7 | — | — | Oiliness improver mixed with pentaerythritol ester and dipentaerythritol ester | 10.0 | — | — | " |
| | Ex. 8 | — | — | Oiliness improver mixed with pentaerythritol ester and dipentaerythritol ester | 10.0 | — | — | " |
| | Ex. 9 | — | — | Oiliness improver mixed with pentaerythritol ester and dipentaerythritol ester | 10.0 | — | — | " |
| | Ex. 10 | — | — | Sorbitan monooleate | 10.0 | — | — | " |
| | Ex. 11 | — | — | " | 10.0 | — | — | " |
| Study on service life, abnormal noise countermeasure and viscosity improver | Ex. 12 | Polyisobutylene | 0.2 | Oiliness improver mixed with pentaerythritol ester and dipentaerythritol ester | 10.0 | — | — | " |
| | Ex. 13 | Polyisobutylene | 0.2 | Oiliness improver mixed with pentaerythritol ester and dipentaerythritol ester | 10.0 | — | — | " |
| | Ex. 14 | Low molecular weight polyethylene | 3.0 | Oiliness improver mixed with pentaerythritol ester and dipentaerythritol ester | 10.0 | — | — | " |
| | Ex. 15 | Polybutene | 10.0 | Sorbitan monooleate | 10.0 | — | — | " |
| | Ex. 16 | Polymethacrylate | 3.85 | Oiliness improver mixed with pentaerythritol ester and dipentaerythritol ester | 7.7 | — | — | " |
| | Ex. 17 | Polybutadiene | 16.7 | Sorbitan monooleate | 10.0 | — | — | " |
| Study on service life, abnormal noise countermeasure and solid lubricant | Ex. 18 | Polyisobutylene | 0.65 | Oiliness improver mixed with pentaerythritol ester and dipentaerythritol ester | 10.0 | Paraffin | 10.0 | " |
| | Ex. 19 | " | " | Oiliness improver mixed with pentaerythritol ester and dipentaerythritol ester | 10.0 | Melamine resin | 10.0 | " |
| | Ex. 20 | " | " | Oiliness improver mixed with pentaerythritol ester and dipentaerythritol ester | 10.0 | Melamine resin | 10.0 | " |
| | Ex. 21 | " | " | Oiliness improver mixed with pentaerythritol ester and dipentaerythritol ester | 10.0 | Silicone resin | 10.0 | " |
| | Ex. 22 | " | " | Oiliness improver mixed with pentaerythritol ester and dipentaerythritol ester | 10.0 | Teflon resin | 10.0 | " |
| Study on service life, abnormal noise countermeasure and solid lubricant and study on contents | Ex. 23 | " | 0.2 | Oiliness improver mixed with pentaerythritol ester and dipentaerythritol ester | 10.0 | Melamine resin | 1.0 | " |
| | Ex. 24 | " | 0.2 | Oiliness improver mixed with pentaerythritol ester and dipentaerythritol ester | 10.0 | Melamine resin | 3.0 | " |
| | Ex. 25 | " | 0.2 | Oiliness improver mixed with pentaerythritol ester and dipentaerythritol ester | 10.0 | Melamine resin | 5.0 | " |
| Study on service life, abnormal noise countermeasure and lithium content | Ex. 26 | " | 0.18 | Oiliness improver mixed with pentaerythritol ester and dipentaerythritol ester | 9.0 | — | — | " |
| | Ex. 27 | " | 0.16 | Oiliness improver mixed with pentaerythritol ester and dipentaerythritol ester | 8.0 | — | — | " |
| | Ex. 28 | " | 0.14 | Oiliness improver mixed with pentaerythritol ester and dipentaerythritol ester | 7.0 | — | — | " |
| | Ex. 29 | " | 0.14 | Oiliness improver mixed with pentaerythritol ester and dipentaerythritol ester | 7.0 | — | — | " |
| | Ex. 30 | " | 0.14 | Oiliness improver mixed with pentaerythritol ester and dipentaerythritol ester | 7.0 | — | — | " |

TABLE 2-continued

| | | Constituent material 3 (viscosity improver) | | Constituent material 4 (oiliness improver) | | Constituent material 5 (solid lubricant) | | |
|---|---|---|---|---|---|---|---|---|
| | | Material | Content wt. % | Material | Content wt. % | Material | Content wt. % | Anticorrosive and antioxidant |
| | Ex. 31 | " | 0.16 | Oiliness improver mixed with pentaerythritol ester and dipentaerythritol ester | — | — | " | |
| | Ex. 32 | " | 0.16 | Oiliness improver mixed with pentaerythritol ester and dipentaerythritol ester | 7.0 | — | — | " |
| Lithium soap | Con. 1 | — | — | Oiliness improver mixed with pentaerythritol ester and dipentaerythritol ester | 5.0 | — | — | Left |
| | Con. 2 | — | — | Oiliness improver mixed with pentaerythritol ester and dipentaerythritol ester | 5.0 | — | — | " |
| | Con. 3 | — | — | Oiliness improver mixed with pentaerythritol ester and dipentaerythritol ester | 5.0 | — | — | " |
| | Con. 4 | — | — | Oiliness improver mixed with pentaerythritol ester and dipentaerythritol ester | 5.0 | — | — | " |
| Bentonite | Con. 5 | — | — | Oiliness improver mixed with pentaerythritol ester and dipentaerythritol ester | 20.0 | — | — | " |
| | Con. 6 | — | — | Oiliness improver mixed with pentaerythritol ester and dipentaerythritol ester | 20.0 | — | — | " |
| | Con. 7 | — | — | Oiliness improver mixed with pentaerythritol ester and dipentaerythritol ester | 20.0 | — | — | " |
| Mat finished worm | Con. 8 | — | — | Oiliness improver mixed with pentaerythritol ester and dipentaerythritol ester | 5.0 | — | — | " |

The examples 1 to 32 shown in Tables 1 and 2 represent experimental results in the case where contents of the fine silica grain were changed and the fine silica grain were added and mixed into base oil of the grease.

In the experiments, chemical synthetic hydrocarbon oil such as ethylene-α-olefin copolymer or poly-α-olefin was used as the base oil of the grease. It is preferable to use, as the base oil, chemical synthetic hydrocarbon oil or mineral oil that is superior in low temperature characteristics, attacked resin and corrosiveness.

The fine silica grain is the fine grain of silicon dioxide ($SiO_2$). Its particle size was for example about 7 to about 40 nm (nanometers) in the experiments. The fine silica grain has a suppressed deviation from spherical form. It is relatively easy to produce the grain having a variety of granular sizes with a controlled grain distribution in low cost. Also, the grain is inorganic and thermally stable.

In addition, the fine silica grain may be subjected to a surface finish such as a lipophilic process with trimethylsilylether. Further, the fine silica grain has the property as consistency increasing agent.

With respect to all the examples and the conventional examples, the experiments were conducted in the cases where the environmental temperatures of the motor were at −30° C., +25° C. and +80° C., respectively. The reason for this is that the motor 1 of the automotive electric window device 2 is to be used in such a wide temperature range.

In the conventional examples 1 to 8, there was no fine silica grain. Lithium soap was contained as the consistency increasing agent in the conventional examples 1 to 4 and bentonite was contained in the conventional examples 5 to 8.

Also, the conventional example 8 shows the same situation as the miniature electric motor with reduction worm gear unit disclosed in the above-described Japanese Patent No. 2636958 in which the surface process was effected to the worm in a mat finishing and the conventional grease was used.

Table 3 shows the output torque $T_2$ after the speed deceleration, the gear transmission efficiency ζ and reverse rotation torque proof in the case where the environment temperature was 25° C. in the examples 2 to 32.

TABLE 3

(Environmental temperature: 25° C.)

| | Output torque $T_2$ [N · m] | Gear transmission efficiency η [%] | Reverse rotation torque proof [N · m] |
|---|---|---|---|
| Ex. 2 | 12.3 | 47.4 | 11.2 |
| Ex. 3 | 12.3 | 47.1 | 13.3 |
| Ex. 4 | 12.2 | 46.8 | 15.3 |
| Ex. 5 | 12.0 | 46.3 | 15.3 |
| Ex. 6 | 12.0 | 46.2 | 15.3 |
| Ex. 7 | 12.0 | 46 | 15.3 |
| Ex. 8 | 11.9 | 45.7 | 15.3 |
| Ex. 9 | 11.5 | 44.3 | 15.3 |
| Ex. 10 | 11.0 | 42.1 | 15.3 |
| Ex. 11 | 10.8 | 41.4 | 15.3 |
| Ex. 12 | 12.0 | 46.1 | 15.3 |
| Ex. 13 | 11.9 | 45.8 | 15.3 |
| Ex. 14 | 13.3 | 51.3 | 5.1 |
| Ex. 15 | 11.9 | 45.7 | 15.3 |
| Ex. 16 | 12.9 | 49.5 | 6.1 |

TABLE 3-continued (Environmental temperature: 25° C.)

| | Output torque $T_2$ [N · m] | Gear transmission efficiency η [%] | Reverse rotation torque proof [N · m] |
|---|---|---|---|
| Ex. 17 | 13.3 | 51.3 | 4.1 |
| Ex. 18 | 13.3 | 51.1 | 4.1 |
| Ex. 19 | 12.1 | 46.4 | 15.3 |
| Ex. 20 | 11.8 | 45.4 | 15.3 |
| Ex. 21 | 8.9 | 34.2 | 15.3 |
| Ex. 22 | 12.8 | 49.1 | 10.2 |
| Ex. 23 | 11.3 | 43.5 | 15.3 |
| Ex. 24 | 11.3 | 43.6 | 15.3 |
| Ex. 25 | 11.2 | 43.2 | 15.3 |
| Ex. 26 | 11.4 | 43.8 | 15.3 |
| Ex. 27 | 11.8 | 45.4 | 15.3 |
| Ex. 28 | 11.8 | 45.5 | 15.3 |
| Ex. 29 | 12.3 | 47.3 | 11.2 |
| Ex. 30 | 13.2 | 50.9 | 4.1 |
| Ex. 31 | 11.8 | 45.3 | 15.3 |
| Ex. 32 | 11.9 | 45.6 | 15.3 |

In Table 3, the gear transmission efficiency ζ is calculated by using the above-described equation from the values of the output torque $T_1$ before the speed deceleration, the reduction gear ratio, the output torque $T_2$ after the speed deceleration.

The reverse rotation torque proof was the actually measured value in each example. If the reverse rotation torque largely exceeds 15.3 N·m (150 kgf·cm), the gears would be damaged. Accordingly, the upper limit for the measurement was 15.3 N·m.

In the motor 1 used in the experiments, if the gear transmission efficiency η was equal to or more than 46.8%, the reverse rotation torque proof was equal to or less than 15.3 N·m due to the performance of the motor itself. Accordingly, the excerpt of the examples met this condition and the gear transmission efficiency ζ and the reverse rotation torque proof thereof from the data of Table 3 is shown in Table 4.

Figure 4:
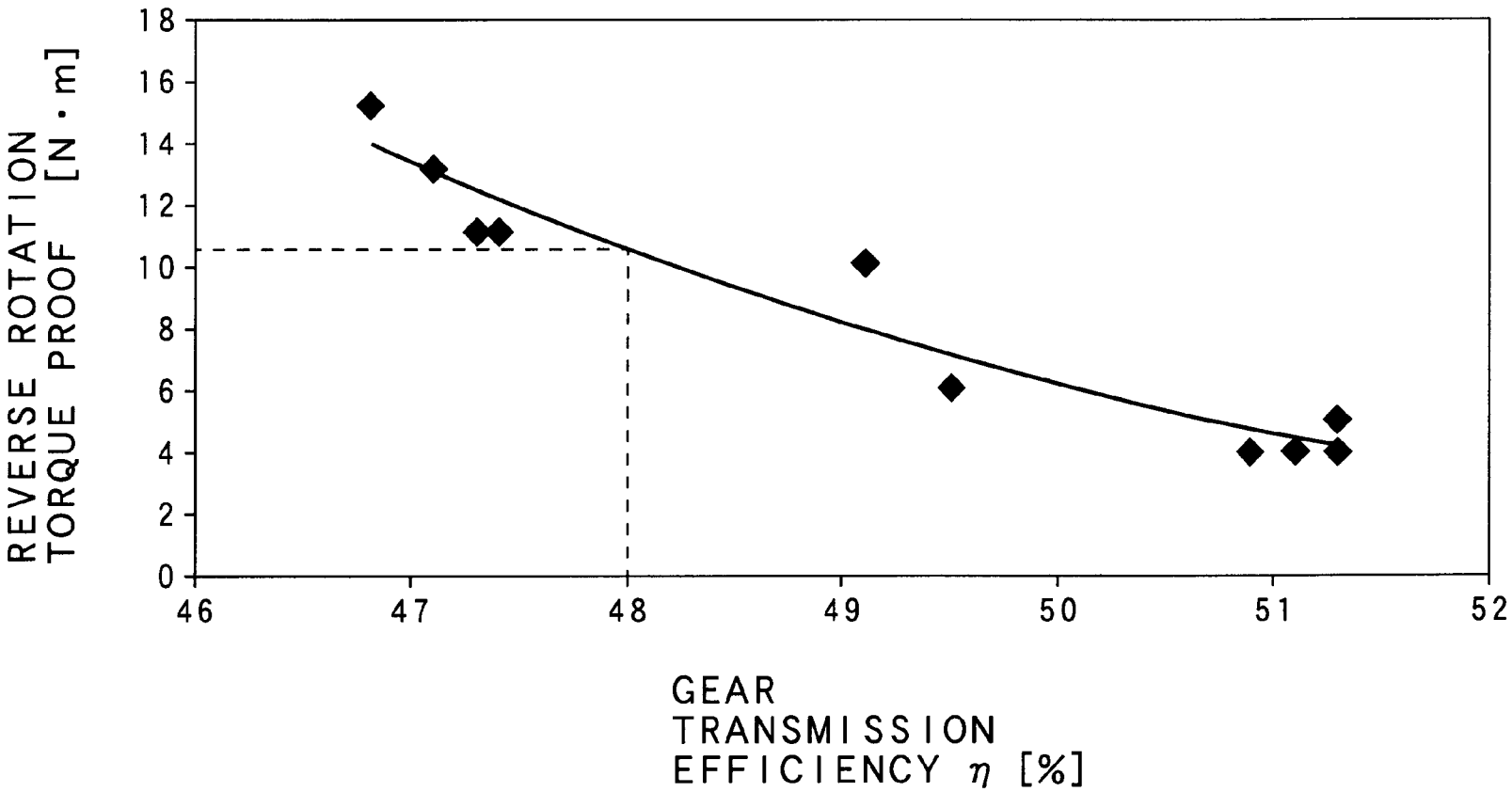

FIG. 4 is a graph showing the values of Table 4. The abscissa axis of FIG. 4 represents the gear transmission efficiency η and the ordinate axis represents the reverse rotation torque proof.

TABLE 4

| | Gear transmission efficiency η [%] | Reverse rotation torque proof [N · m] |
|---|---|---|
| Ex. 4 | 46.8 | 15.3 |
| Ex. 3 | 47.1 | 13.3 |
| Ex. 29 | 47.3 | 11.2 |
| Ex. 2 | 47.4 | 11.2 |
| Ex. 22 | 49.1 | 10.2 |
| Ex. 16 | 49.5 | 6.12 |
| Ex. 30 | 50.9 | 4.1 |
| Ex. 18 | 51.1 | 4.1 |
| Ex. 14 | 51.3 | 5.1 |
| Ex. 17 | 51.3 | 4.1 |

In Table 4 and FIG. 4, in case of the electric window device 2 used in the experiments, if the reverse rotation torque proof was equal to or more than 10.5 N·m, i.e., the gear transmission efficiency η was equal to or less than 48%, it was possible to obtain the good reverse rotation proof.

Namely, if the gear transmission efficiency η exceeded 48%, the loss of the power transmission through the worm gears 22 was reduced but the reverse rotation torque proof, i.e., the reverse rotation proof was reduced. Accordingly, if the external force P in the opening direction was applied, there was a possibility that the window glass 4 would be opened.

Incidentally, the relationship between the gear transmission efficiency η and the reverse rotation torque proof and the predetermined value of the gear transmission efficiency η are determined depending upon the change of the structure of the electric window device 2, the shape or weight of the window glass 4 and the power transmission mechanism.

As shown in Tables 1 and 2, the fine silica grain was added and mixed to the base oil and the content of the fine silica grain was changed from about 2.0 to about 25.0 wt. (weight) % in the examples 1 to 11. In this case, in order to exclude the affects of other constituent materials such as viscosity improver or solid lubricant, these other constituent materials were not added.

As a result, it was confirmed by, for example, the examples 2 to 11 or the like, that, when the fine silica grain was added and mixed to the base oil, irrespective of the content of the fine silica grain, the gear transmission efficiency η was not changed in the wide environmental temperature range (i.e., −30° C., +25° C., +80° C.) but kept substantially constant. Incidentally, in the example 1, the lubricant did not become grease but liquefied when the content of the fine silica grain was 2.0 wt. %. Thus, the experiment of the example 1 was not conducted because of the liquescence of the lubricant.

In contrast, in the conventional examples 1 to 8, when the environmental temperature was changed, the gear transmission efficiency η was largely changed.

Figure 5:
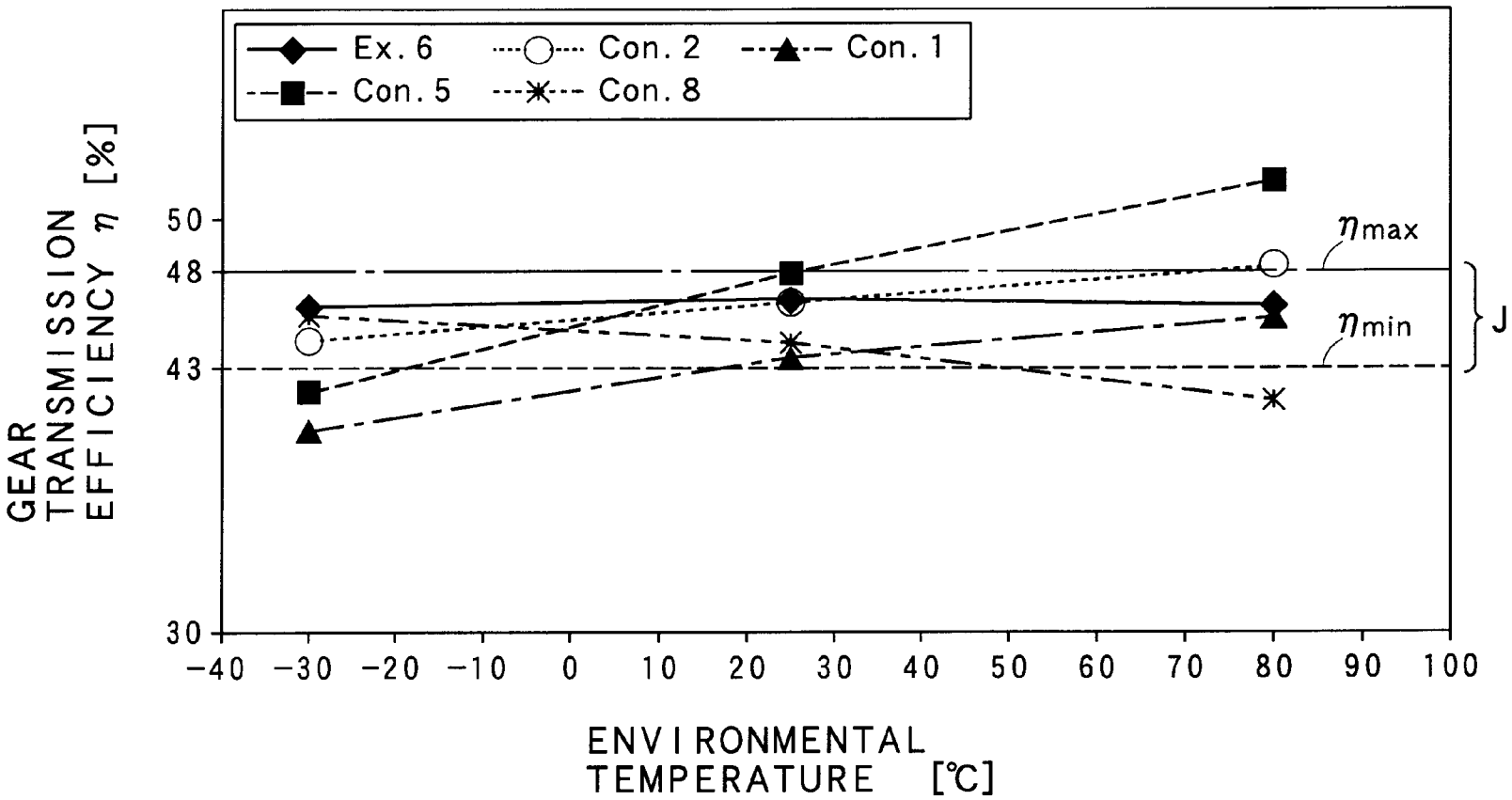

FIG. 5 is a graph showing the relationship between the environmental temperature (abscissa axis) and the gear transmission efficiency η (ordinate axis). In FIG. 5, the example 6 and the conventional examples 1, 2, 5 and 8 are exemplified.

In the electric window device 2 used in this experiment, as shown in FIG. 4, the gear transmission efficiency η at which the desired reverse rotation proof could be ensured was about 48% at the maximum value $\eta_{max}$. Also, as a result of the measurement, the minimum value $\eta_{min}$ of the gear transmission efficiency η was about 43%. Accordingly, in order to obtain the desired reverse rotation proof, a range J of the gear transmission efficiency η was ranged from the minimum $\eta_{min}$ to the maximum $\eta_{max}$.

As shown in FIG. 5, with the grease of the conventional examples 1, 2, 5 and 8 in which the lithium soap or the bentonite was added and mixed as the consistency increasing agent, when the environmental temperature was changed, the gear transmission efficiency η was largely changed.

Namely, even if the reverse rotation proof might be maintained at 25° C., but it was in the severe conditions such as −30° C. or +80° C., there were cases where the gear transmission efficiency η was out of the desired range J. For example, in the conventional example 5, the gear transmission efficiency η at 80° C. was a large value exceeding the maximum value $\eta_{max}$.

In the same manner, in the conventional examples 1 and 8, there were cases where the gear transmission efficiency η was lower than the minimum value $\eta_{min}$ depending upon the environmental temperature. In these cases, in order to keep the stall torque, the motor had to be enlarged.

In contrast, in the example 6, even if the environmental temperature was changed, the gear transmission efficiency η was kept substantially constant and was maintained within the desired range J. Accordingly, the desired gear transmission efficiency η was always kept in the wide environmental temperature range so that the reverse rotation proof might be maintained.

Figure 6:
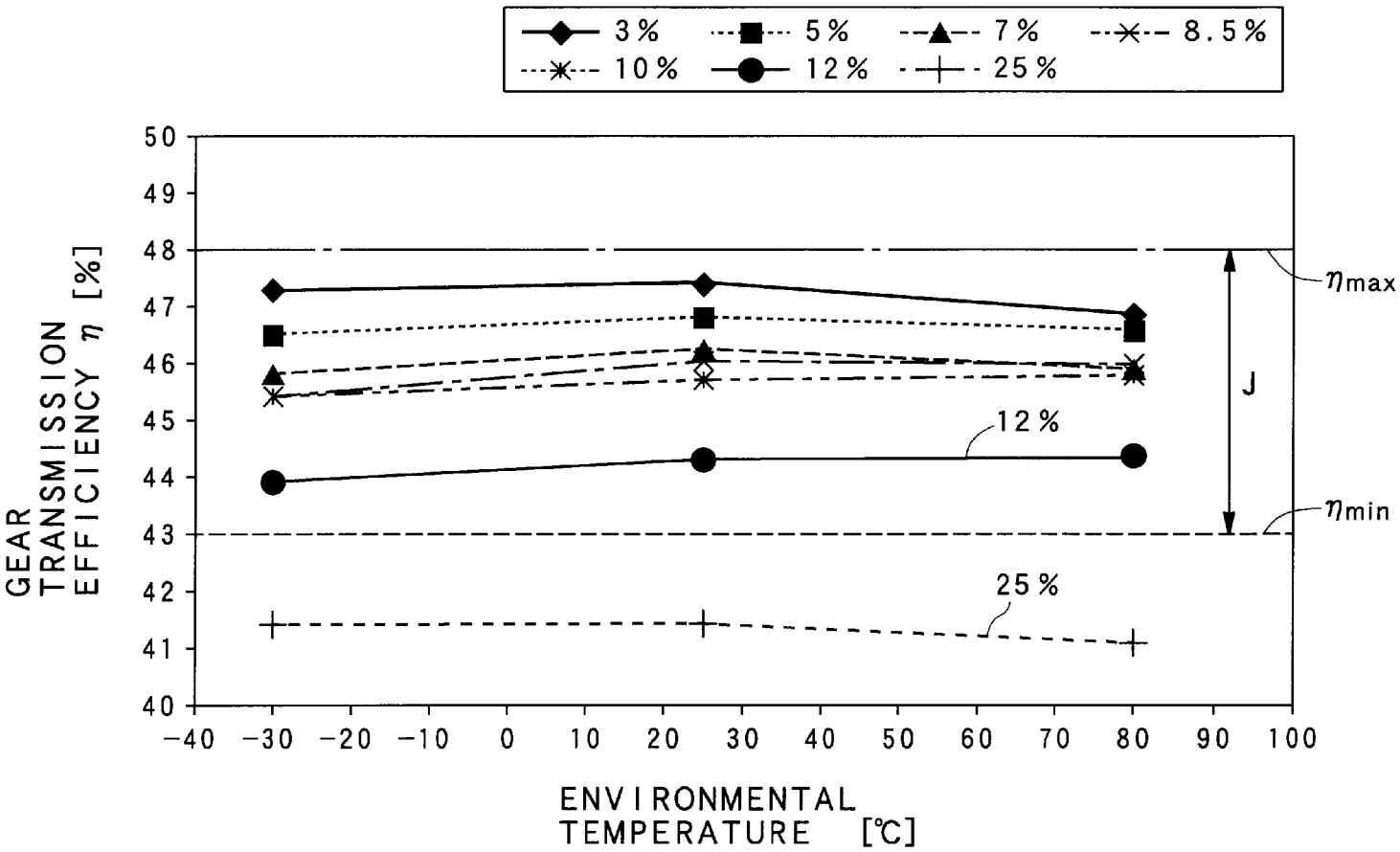

Table 5 shows the gear transmission efficiency η for every content of the fine silica grain. FIG. 6 is a graph showing this. The abscissa axis of FIG. 6 represents the environmental temperature and the ordinat e axis represents the gear transmission efficiency η.

TABLE 5

| | | Environmental temperature | Gear transmission efficiency η [%] −30° C. | 25° C. | 80° C. |
|---|---|---|---|---|---|
| Content of fine silica grain [wt. %] | 3% | Ex. 2 | 47.3 | 47.4 | 46.9 |
| | 5% | Ex. 4 | 46.5 | 46.8 | 46.6 |
| | 7% | Ex. 6 | 45.8 | 46.2 | 45.9 |
| | 8.5% | Ex. 7 | 45.4 | 46 | 46 |
| | 10% | Ex. 8 | 45.4 | 45.7 | 45.8 |
| | 12% | Ex. 9 | 43.9 | 44.3 | 44.4 |
| | 25% | Ex. 11 | 41.4 | 41.4 | 41.1 |

As is apparent in Table 5 and FIG. 6, it is understood that, if the fine silica grain was contained, the gear transmission efficiency η was kept substantially constant in the wide environmental temperature range (−30° C., +25° C., +80° C.).

However, as shown in the example 11, when the content of the fine silica grain was 25 wt. %, the gear transmission efficiency η was lower than the minimum value $\eta_{min}$. Accordingly, it was necessary to enlarge the motor to increase the power.

Subsequently, the condition of change of the life cycle numbers and the gear transmission efficiency η at each content of the fine silica grain was measured.

Figure 7:
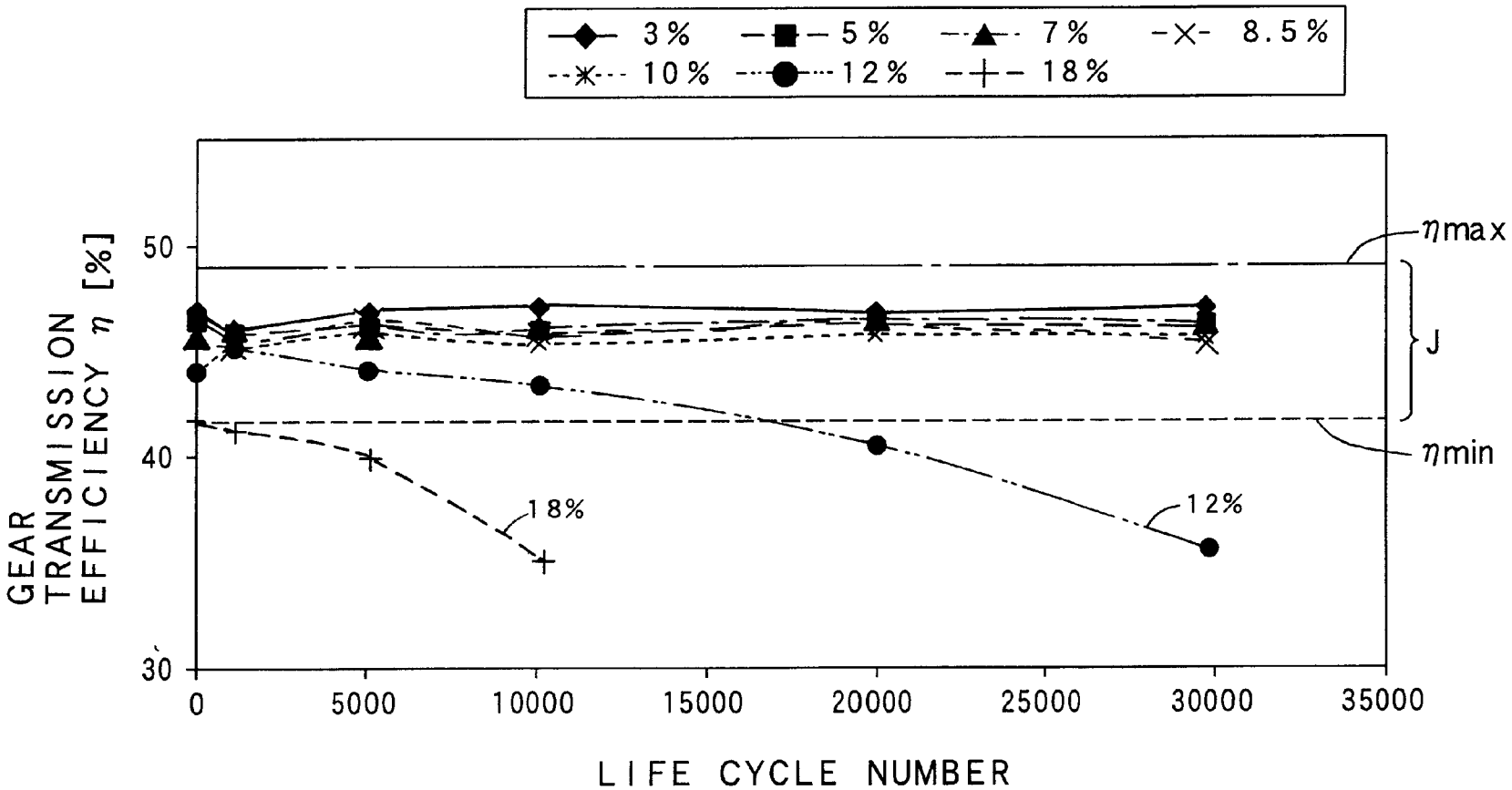

Table 6 shows the gear transmission efficiency η at each life cycle number (0, 1,000, 5,000, 10,000, 20,000, 30,000). FIG. 7 is a graph showing this. The abscissa axis of FIG. 7 represents the life cycle number and the ordinate axis represents the gear transmission efficiency η.

TABLE 6

| | | Life cycle Nos. | Gear transmission efficiency η [%] 0 | 1000 | 5000 | 10000 | 20000 | 30000 |
|---|---|---|---|---|---|---|---|---|
| Content of fine silica grain [wt. %] | 3% | Ex. 2 | 47.4 | 46.3 | 47.1 | 47.3 | 46.9 | 47.1 |
| | 5% | Ex. 4 | 46.8 | 46 | 46.5 | 45.8 | 46.4 | 46.2 |
| | 7% | Ex. 6 | 46.2 | 46.3 | 45.9 | 46.3 | 46.6 | 46.5 |
| | 8.5% | Ex. 7 | 46 | 45.5 | 46.7 | 45.9 | 46.4 | 45.5 |
| | 10% | Ex. 8 | 45.7 | 45.4 | 46.1 | 45.5 | 45.9 | 45.8 |
| | 12% | Ex. 9 | 44.3 | 45.3 | 44.3 | 43.5 | 40.6 | 35.6 |
| | 18% | Ex. 10 | 42.1 | 41.5 | 40.1 | 35.1 | | |

Here, one life cycle means one operation of opening/closing the window glass 4 of the electric window device 2. The life cycle number that is practically needed for the electric window device 2 is 20,000 cycles by way of example.

As shown in Table 6 and FIG. 7, when the content of the fine silica grain in the grease was in a range of about 3 to about 10 wt. % (namely, in the examples 2, 4, 6, 7 and 8), the gear transmission efficiencies η fell within the desired range J and were kept substantially constant within the life cycle numbers between zero to 30,000. Accordingly, it is understood that the desired reverse rotation proof was ensured.

However, in the cases where the content of the fine silica grain was 12 wt. % (example 9) and 18 wt. % (example 10), when the life cycle number was increased, the gear transmission efficiency η was gradually decreased to be less than the minimum value $\eta_{min}$. The reason for this was that the loss of the power transmission of the warm gears 22 was gradually increased. This means a difficulty of the operation of opening/closing the window glass 4.

Accordingly, in order to keep long the service life of the motor with the life cycle number practically needed for the electric window device 2 while keeping the desired gear transmission efficiency η, the content of the fine silica grain was preferably in a range of about 3 to about 10 wt. %.

As shown in Table 1, in the case where the content of the fine silica grain was in a range of 8.5 wt. % (example 7) to 25 wt. % (example 11), there was the fear that the motor 1 produced abnormal noise.

Therefore, in order to prevent the generation of the abnormal noise in addition to the above-described condition of the content of the fine silica grain, the experiment to add and mix a predetermined amount of at least one of the oiliness improver, the viscosity improver, the solid lubricant and the consistency increasing agent was conducted.

Figure 8:
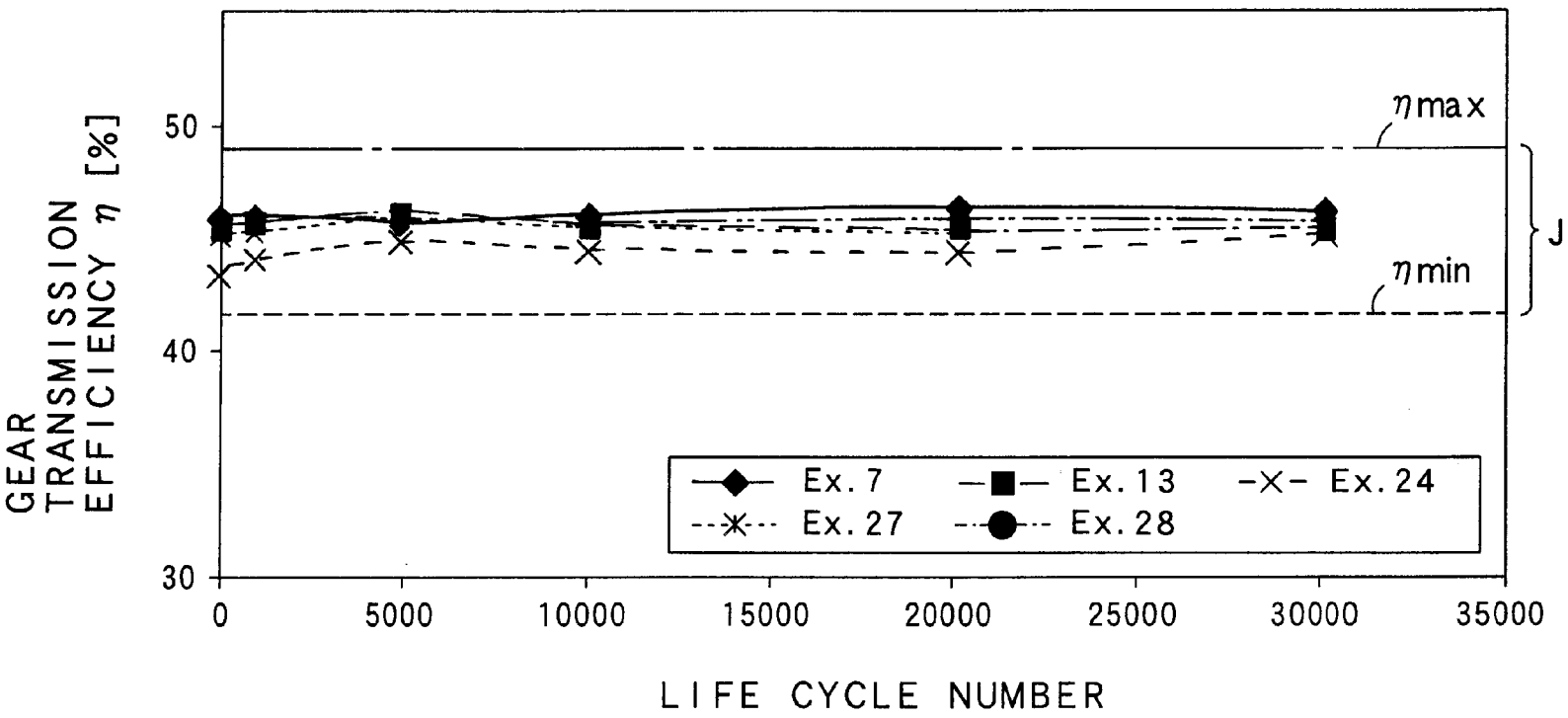

Table 7 shows the relationship between the gear transmission efficiency η and the life cycle number due to the content of the additive. FIG. 8 is a graph showing this. The abscissa axis of FIG. 8 represents the life cycle number and the ordinate axis represents the gear transmission efficiency η.

TABLE 7

| Content of additive | | Life cycle Nos. | Gear transmission efficiency η [%] 0 | 1000 | 5000 | 10000 | 20000 | 30000 |
|---|---|---|---|---|---|---|---|---|
| Basic structure | | Ex. 7 | 46.2 | 46.3 | 45.9 | 46.3 | 46.6 | 46.5 |
| Viscosity improver | Polyisobutylene | Ex. 13 | 45.8 | 46 | 46.5 | 45.8 | 45.5 | 45.6 |
| Solid lubricant | Melamine resin 3% | Ex. 24 | 43.6 | 44.3 | 45.1 | 44.7 | 44.6 | 45.5 |
| Lithium soap | Content 1.5% | Ex. 27 | 45.4 | 45.5 | 46.1 | 45.7 | 45.5 | 45.8 |
| Lithium soap | Content 2.5% | Ex. 28 | 45.5 | 46.1 | 46.2 | 45.9 | 46.1 | 46 |

As shown in Tables 1, 2, 7 and FIG. 8, in the examples 12 to 17, the addition and mixture of the viscosity improver for the purpose of preventing the generation of the abnormal noise and maintenance of the necessary life cycle number was considered. The viscosity improver has the characteristics to increase the adhesive coefficient of the grease and to improve the adhesive property thereof.

The viscosity improver is at least one selected from the group consisting of polyisobutylene, polybutene (polybutylene), low molecular weight polyethylene, polybutadiene and poly methacrylate. If a predetermined amount of this viscosity improver was added and mixed, it was confirmed that no abnormal noise was generated even if the content of the fine silica grain was equal to or more than 8.5 wt. %.

As the characteristics of the viscosity improver, the polyisobutylene and the polybutene might keep the gear transmission efficiency substantially constant irrespective of the environmental temperature. With the low molecular weight polyethylene, polybutadiene and poly methacrylate, although the gear transmission efficiency was slightly increased, the gear transmission efficiency due to the environmental temperature change was kept substantially constant and no abnormal noise was generated.

In all the examples and conventional examples, the oiliness improver and a small amount of anticorrosive and antioxidant were added and mixed to the grease. The oiliness improver was at least one selected from sorbitan fatty acid ester and ester structured of copolymer. For example, it is preferable to use sorbitan monooleate, oiliness improver mixed with pentaerythritol ester and dipentaerythritol ester or the like.

In the case where predetermined contents (wt. %) of these oiliness improvers and viscosity improvers (whose components were vegetable oils, fatty acid ester, polyolester) were added and mixed and the grease composed of fine silica grain was used, no abnormal noise was generated.

In the examples 18 to 25, in order to maintain the necessary life cycle number and to prevent the generation of the abnormal noise, the solid lubricant was added and mixed. The solid lubricant was selected from the group consisting of melamine resin, silicone resin, paraffin and fluorocarbon resin (Teflon (trademark)). In the examples 23 to 25, the content of the melamine resin was considered.

By adding and mixing this solid lubricant, it was possible to prevent the generation of the abnormal noise while keeping the necessary life cycle number.

As the characteristics of the solid lubricant, the melamine resin and the silicone resin were effective to always keep the gear transmission efficiency at the substantially constant desired value irrespective of the environmental temperature. Also, with the low molecular weight paraffin and fluorocarbon resin, although the gear transmission efficiency was slightly increased, the gear transmission efficiency due to the environmental temperature change was kept substantially constant and no abnormal noise was generated.

Therefore, by containing a predetermined amount of the solid lubricant (for example, boron nitride, fine electric black lead powder in addition to the above-described substance), in the case where the grease made of fine silica grain was used, no abnormal noise was generated.

Subsequently, in the examples 26 to 32, for the purpose of maintaining the necessary life cycle number and preventing the generation of the abnormal noise, the consistency increasing agent selected from lithium soap, bentonite and polyurea resin was added and mixed. The consistency increasing agent imparts non-Newtonian property to the grease.

In the examples 26 to 32, 0.5 to 4.0 wt. % of lithium soap was contained. In particular, in the examples 29 and 30, the contents of the lithium soap were 3.0 and 4.0 wt. %, respectively and the gear transmission efficiency was largely changed in a range of the environmental temperature. Accordingly, it was preferred that the content of the consistency increasing agent was in a range of 0.5 to 2.5 wt. %.

As is apparent from Table 7 and FIG. 8, in the examples 7, 13, 24, 27 and 28, the gear transmission efficiency η was always in the desired range J.

The effect of the examples 12 to 32 shown in the respective tables and drawings is totally judged. As a result, for the countermeasure of the abnormal noise and the service life of the motor, it is preferable to add and mix at least one, in a range of about 0.2 to about 20.0 wt. %, selected from the group of the oiliness improver, the viscosity improver, the solid lubricant and the consistency increasing agent to the grease into which the fine silica grain is added and mixed.

Thus, it is possible to always maintain the reverse rotation proof while always keeping the desired gear transmission efficiency η in the wide environmental temperature range. Also, it is possible to prevent the generation of the abnormal noise while keeping the sufficient life cycle number.

Incidentally, in the grease in which at least fine silica grain is added and mixed to the base oil, the content of rest base oil is in a range of about 70 to about 96 wt. %.

Thus, according to the present invention, in the grease for lubricating the worm gears 22 of the motor 1, the fine silica grain is added and mixed to the base oil and the content of the fine silica grain is in a range of about 3 to about 10 wt. %.

Thus, it is possible to always maintain the reverse rotation proof while always keep the desired gear transmission efficiency η in the wide environmental temperature range (i.e., −30° C. to +80° C.).

Accordingly, there is no fear that the window glass 4 is opened by the external force P in the opening direction so that burglar proof and security may be ensured. Also, the worm gears 22 are smoothly rotated during the rotation thereof, the above-described mutually conflicting first and second functions may be exhibited. As a result, it is possible to miniaturize the motor 1 and to increase the life cycle number to prolong the service life of the motor.

By controlling the content of the fine silica grain in the predetermined range or by adding and mixing the viscosity improver or the like in addition to the fine silica grain, it is possible to prevent the generation of the abnormal noise and therefore it is possible to reduce the noise of the motor to keep the motor quiet.

Also, since it is unnecessary to apply the mat finishing to the worm gears 22 as in the conventional process, it is possible to reduce the number of steps of the production, which leads to the reduction in cost.

Incidentally, the same reference numerals are used to indicate the same members or components throughout the accompanying drawings.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A miniature electric motor with a reduction worm gear unit arranged to drive an electric window device for automatically opening or closing a window glass of an automotive vehicle, in which the reduction worm gear unit is mounted on a motor portion and an output of the motor portion is subjected to a speed reduction through the reduction worm gear unit, characterized in that:

in lubricant for lubricating worm gears of the reduction worm gear unit, fine silica grain having a range of about 7 to about 40 nm is added and mixed to a base oil, and a content of the fine silica grain is in a range of −30° C. to +80° C. of about 3 to about 10 wt. %, so that gear transmission efficiency of said worm gears is maintained in a predetermined range in a predetermined environmental temperature range of −30° C. to +80° C., wherein said worm gears exhibit a first function that reverse rotation proof is maintained by a predetermined static frictional force so that the window glass is not opened by an external force when said electric window device is kept under a static condition, and a second function that said worm gears are smoothly rotated with a frictional force equal to or less than a predetermined dynamic frictional force while the dynamic frictional force is abruptly reduced during the rotation.

2. The miniature electric motor according to claim 1, wherein said worm gears are composed of a worm formed out of carbon steel and a worm wheel formed out of synthetic resin.

3. The miniature electric motor according to claim 1, wherein at least one selected from the group of oiliness improver, viscosity improver, solid lubricant and consistency increasing agent is added and mixed to the lubricant into which the fine silica grain is added.

4. The miniature electric motor according to claim 3, wherein said oiliness improver is at least one selected from the group of sorbitan fatty acid ester and ester structured of copolymer;

said viscosity improver is at least one selected from the group of polyisobutylene, polybutene, low molecular weight polyethylene, polybutadiene and poly methacrylate;

said solid lubricant is selected from the group of melamine resin, silicone resin, paraffin and fluorocarbon resin; and said consistency increasing agent is selected from the group of lithium soap, bentonite and polyurea resin.

5. The miniature electric motor according to claim 4, wherein said oiliness improver is sorbitan monooleate or oiliness improver mixed with pentaerythritol ester and dipentaerythritol ester.

6. The miniature electric motor according to claim 4, wherein said solid lubricant contains further boron nitride and fine electric black lead powder.

7. The miniature electric motor according to claim 4, wherein at least one selected from the group of said oiliness improver, said viscosity improver, said solid lubricant and said consistency increasing agent is added and mixed to the lubricant into which the fine silica grain is added is in a range of about 0.2 to about 20.0 wt. %.

8. The miniature electric motor according to claim 7, wherein the content of said consistency increasing agent is in a range of about 0.5 to about 2.5 wt. %.

9. The miniature electric motor according to claim 1, wherein said base oil is chemical synthetic hydrocarbon oil or mineral oil that is superior in low temperature characteristics, attacked resin and corrosiveness.

10. The miniature electric motor according to claim 9, wherein said chemical synthetic hydrocarbon oil is ethylene-α-olefin copolymer or poly-α-olefin.

11. A miniature electric motor with a reduction worm gear unit in which the reduction worm gear unit is mounted on a motor portion and an output of the motor portion is subjected to a speed reduction through the reduction worm gear unit, characterized in that:

in lubricant for lubricating worm gears of the reduction worm gear unit, fine silica grain having a range of about 7 to about 40 nm is added and mixed to a base oil, and a content of the fine silica grain is in a range of about 3 to 10 wt. %, so that gear transmission efficiency of said worm gears is maintained in a predetermined range in a predetermined environmental temperature range, wherein said worm gears exhibit a first function that reverse rotation proof is maintained by a predetermined static frictional force when said miniature electric motor is turned off under a static condition, and a second function that said worm gears are smoothly rotated with a frictional force equal to or less than a predetermined dynamic frictional force while the dynamic frictional force is abruptly reduced during the rotation after the miniature electric motor is turned on to a dynamic friction.

12. The miniature electric motor according to claim 11, wherein at least one selected from the group of oiliness improver, viscosity improver, solid lubricant and consistency increasing agent is added and mixed to the lubricant into which the fine silica grain is added.

13. The miniature electric motor according to claim 12, wherein said oiliness improver is at least one selected from the group of sorbitan fatty acid eater and ester structured of copolymer;

said viscosity improver is at least one selected from the group of polyisobutylene, polybutene, low molecular weight polyethylene, polybutadience and poly methacrylate;

said solid lubricant is selected from the group of melamine resin, silicone resin, paraffin and fluorocarbon resin; and said consistency increasing agent is selected from the group of lithium soap, bentonite and polyurea resin.

14. The miniature electric motor according to claim 13, wherein said oiliness improver is sorbitan monooleate or oiliness improver mixed with pentaerythritol ester and dipentaerythritol ester.

15. The miniature electric motor according to claim 13, wherein said solid lubricant contains further boron nitride and fine electric black lead powder.

16. The miniature electric motor according to claim 13, wherein at least one selected from the group of said oiliness improver, said viscosity improver, said solid lubricant and said consistency increasing agent is added and mixed to the lubricant into which the fine silica grain is added is in a range of about 0.2 to about 20.0 wt. %.

17. The miniature electric motor according to claim 16, wherein the content of said consistency increasing agent is in a range of about 0.5 to about 2.5 wt. %.

18. The miniature electric motor according to claim 11, wherein said base oil is chemical synthetic hydrocarbon oil or mineral oil that is superior in low temperature characteristics, attacked resin and corrosiveness.

19. The miniature electric motor according to claim 18, wherein said chemical synthetic hydrocarbon oil is ethylene-α-olefin copolymer or poly-α-olefin.

20. The miniature electric motor according to claim 11, wherein said worm gears are composed of a worm formed out of carbon steel and a worm wheel formed out of synthetic resin.

* * * * *